US012714908B1

(12) United States Patent
Ponomarov et al.

(10) Patent No.: US 12,714,908 B1
(45) Date of Patent: Aug. 25, 2026

(54) CERVICAL SPINE AND NECK MUSCLES STRENGTHENING APPARATUS AND METHODS FOR PRODUCING AND ADJUSTING THEREOF

(71) Applicants: Serhii Ponomarov, Dnipro (UA); Valentyna Ponomarova, Dnipro (UA); Tetiana Ponomarova, Dnipro (UA); Anna Ponomarova, Dnipro (UA)

(72) Inventors: Serhii Ponomarov, Dnipro (UA); Valentyna Ponomarova, Dnipro (UA); Tetiana Ponomarova, Dnipro (UA); Anna Ponomarova, Dnipro (UA)

( * ) Notice: Subject to any disclaimer, the term of this patent is extended or adjusted under 35 U.S.C. 154(b) by 0 days.

(21) Appl. No.: 18/138,310

(22) Filed: Apr. 24, 2023

(51) Int. Cl.

| | |
|---|---|
| ***A63B 23/025*** | (2006.01) |
| ***A63B 21/00*** | (2006.01) |
| ***A63B 21/055*** | (2006.01) |
| ***A63B 21/16*** | (2006.01) |
| ***A63B 23/00*** | (2006.01) |
| ***A63B 23/02*** | (2006.01) |

(52) U.S. Cl.
CPC ..... *A63B 23/025* (2013.01); *A63B 21/00178* (2013.01); *A63B 21/0555* (2013.01); *A63B 21/0557* (2013.01); *A63B 21/4003* (2015.10); *A63B 23/0238* (2013.01); *A63B 23/0244* (2013.01); *A63B 21/1663* (2013.01); *A63B 2023/006* (2013.01)

(58) Field of Classification Search
CPC ..... A63B 21/00178; A63B 21/0555; A63B 21/0557; A63B 21/1663; A63B 21/4003; A63B 23/0238; A63B 23/0244; A63B 23/025; A63B 2023/006
See application file for complete search history.

(56) References Cited

U.S. PATENT DOCUMENTS

| | | | | |
|---|---|---|---|---|
| 2,701,564 | A * | 2/1955 | Wilhelm | A63B 21/1645 482/10 |
| 2,716,027 | A * | 8/1955 | Gehri | A63B 21/154 482/131 |
| 3,221,735 | A | 12/1965 | Goodman et al. | |
| 3,654,922 | A * | 4/1972 | Outcalt | A63B 21/1663 D24/188 |
| 6,036,625 | A | 3/2000 | Woodruff | |
| 6,939,269 | B2 * | 9/2005 | Makofsky | A63B 21/4003 482/10 |
| 7,468,019 | B2 * | 12/2008 | Zylstra | A63B 69/0057 482/130 |
| 8,221,293 | B2 * | 7/2012 | Hoffman | A63B 24/0062 482/8 |
| 8,840,528 | B2 | 9/2014 | Zylstra | |
| 9,789,350 | B1 | 10/2017 | Wu | |
| 9,901,775 | B2 | 2/2018 | Sykes | |

(Continued)

*Primary Examiner* — Megan Anderson
(74) *Attorney, Agent, or Firm* — Michael D. Eisenberg; MDE Patents

(57) ABSTRACT

A cervical spine and neck muscles strengthening apparatus and methods are disclosed. The apparatus includes a headgear configured to fit a head in two planes. A traction control line includes a part selected from a non-elastic cord and an elastic cord. A special spring provides frictional engagement for controlled sliding of the line to automatically determine a zero traction force point. The apparatus is configured for enhancing a muscular corset and improving general physical well-being in household conditions.

10 Claims, 12 Drawing Sheets

(56) References Cited

U.S. PATENT DOCUMENTS

| | | | | |
|---|---|---|---|---|
| 10,307,636 | B1 * | 6/2019 | Brown | A63B 21/4003 |
| 10,813,784 | B2 | 10/2020 | Sudell | |
| 11,007,405 | B2 * | 5/2021 | Hunt | A63B 21/4025 |
| 11,247,092 | B2 * | 2/2022 | Albert Garcia | A63B 21/0552 |
| 2019/0201732 | A1 * | 7/2019 | Chang | A63B 21/0557 |
| 2024/0091583 | A1 * | 3/2024 | Parsons | A63B 21/16 |

* cited by examiner 30
50
74
102
41
30
50
74
907
42
41

28
73
20
21
11
101
15
10
14

41
42
906
73
28
21
60

CERVICAL SPINE AND NECK MUSCLES STRENGTHENING APPARATUS AND METHODS FOR PRODUCING AND ADJUSTING THEREOF

TECHNICAL FIELD

The present invention relates to a cervical spine and neck muscles strengthening apparatus (hereinafter "the apparatus") and methods for strengthening neck muscles and preventing musculoskeletal discomfort in a cervical spine area. The apparatus is particularly configured for use in household conditions to enhance a muscular corset and improve a general physical well-being of an individual.

BACKGROUND OF THE INVENTION

Individuals experience physical discomfort and muscle tension in the cervical spine area. Recent studies suggest a connection between degenerative changes in the cervical spine and reduced physiological well-being. Compression of tissues and impaired nerve conduction can lead to various physiological stressors, reduced quality of life, and discomfort in a head and neck region.

As intervertebral discs undergo structural changes, a distance between vertebrae decreases, discomfort and overstrain of the neck muscles occur, and cartilaginous discs lose their stability. Persistent tension in a cervical region can lead to postural changes and restricted mobility.

A deformity of the cervical spine has become widespread due to modern ergonomic challenges, such as the prolonged use of mobile devices and computers, often resulting in a posture with the head tilted forward. This tilt leads to an uneven load on the cervical spine, muscle spasms, and postural deviations.

Various traction methods are used for addressing cervical tension. Numerous inventions are devoted to an implementation of the traction methods. However, methods of passive traction allow individuals to achieve only a short-term result, resulting in temporary relief of pain, since they do not eliminate a root cause of instability-a lack of the strong muscular corset.

For proper maintenance of cervical tissues, it is beneficial to activate circulation in the areas surrounding the intervertebral discs. This can be achieved through active resistance exercises where neck muscles overcome a controlled traction force. The use of an apparatus, in which the muscles overcome the resistance of a traction force during exercise, allows individuals to comprehensively and most naturally improve the cervical spine. A resulting blood flow leads to improved cartilage nutrition, strengthens ligaments and muscles. The traction force helps to relax spasmodic areas, increase intervertebral spaces, eliminate compression of blood vessels and nerve fibers, improve arterial and venous circulation, and naturally improves a functional state of the cervical spine.

Strengthening the muscle corset eliminates the instability of the cervical spine, providing a long-term restorative effect and helping maintain the stability of the cervical spine.

In patents describing passive traction, various types of headgear are proposed, either not allowing their use for training purposes at all, or constructively representing scarves covering heads under the chin and the back of the head; the ends of such scarves diverge in different directions and are attached to a rocker. Such solutions also make it impossible to use devices for neck muscle training, since head movements, if possible at all, do not require any significant muscle effort.

The traction force in existing devices is often generated using winches, weights, or pre-stretched elastic elements. However, many such systems lack precise and repeatable regulation of the traction force.

For example, U.S. Pat. No. 10,307,636 discloses a neck and shoulder exercise device. A headgear of the device contains many straps which greatly complicate the process of its manufacture. The presence of an adjustable chin fastener cannot ensure a snug fit of all bands of the headgear, and a band covering the forehead and the back of the head does not have features of length adjustment at all. The headgear cannot be adapted to fit heads of different sizes and shapes. Such designs often lack effective length adjustment for the bands covering the forehead and the back of the head, failing to provide a natural tight fit for various head sizes and shapes.

U.S. Pat. No. 8,840,528 describes a portable neck exercise device. A headgear of the device has the same drawbacks as the device claimed in U.S. Pat. No. 10,307,636. In addition, with a possibility of obtaining a traction force, setting a specific, calibrated traction force is not possible. The device is bulky and can damage door frames when mounted in a doorway.

U.S. Pat. No. 7,468,019 describes a neck exercise machine. A headgear includes only a horizontal band, which requires a large compression force to remain on the head, leading to discomfort and circulatory disruption. Such designs often fail to remain securely on the head when subjected to significant loads during exercises in the sagittal plane.

According to U.S. Pat. No. 6,036,625, in the neck exercise apparatus there is no possibility of using a traction force, the regulation of the traction force to counteract muscle forces is set purely intuitively during training, which prevents the systematic and safe increase of loads.

U.S. Pat. No. 9,789,350 claims a headgear with the ability to adapt to heads of various sizes and shapes. However, the implementation of the goal has led to the fact that the total number of control points is eight. Asymmetric shortening of bands leads to an insecure fit of the headgear. In addition, the device completely lacks the ability to adjust the length of the frontal-temporal section of the band, which, in the case of a small head size of an individual, leads to a shift of the band covering the head from the top of the head to the chin on the individual's ears, which is unacceptable.

U.S. Pat. No. 9,901,775 discloses a headgear that is not configured to maintain its position when an active traction force is applied.

According to U.S. Pat. No. 10,813,784, it involves regulating traction force by changing a distance from the head of an individual lying on the floor to a door. Such a method is impractical as the exact setting of the traction force requires calculations using a parallelogram rule and Hooke's law, with the use of tables showing force dependence on both a clamping height and a distance from the door to the head. Such complexity often leads to errors in force setting.

The passive traction device disclosed in U.S. Pat. No. 3,221,735 cannot be used as a muscle strengthening machine because the traction force is applied to the base of the skull and tilting the head does not generate a counterforce against muscle efforts. The method for regulating traction force has significant drawbacks. Before setting the traction force with graduated belts, an individual has to, with the help of special belts, bring both lines of belts into a tensioned position, choosing the slack. To do that on two bands by touch, in conditions where a head is not in a fixed position, is extremely difficult. Furthermore, the process of removing slack from the belts is based on subjective feelings, which prevents the establishment of an exact traction force.

In addition, the transfer of belts to a tensioned position with the removal of slack can be performed only by creating the tension in a force line, with stretching of elastic cords. It is not possible to take into account the magnitude of such traction force, since the end of the slack removal process is based solely on subjective feelings of the individual. Experience in testing conventional apparatuses shows that fluctuations in the traction force in the subjective determination of a sufficient degree of tightness of a headgear cause force fluctuations so significant that precise traction load setting becomes impossible. Thus, it is very difficult to establish any exact traction force in this device. Another significant disadvantage of the device is that when using the device by several individuals of different heights, such a complex adjustment needs to be repeated before each procedure. This is particularly problematic when the device is used for heads of different sizes, as the entire complex adjustment process must be repeated each time.

The ability to set the exact traction force is of great importance, as it allows an individual to determine and maintain the optimal traction force for the current condition of the neck muscles, to increase the traction force gradually, from session to session, preventing muscle spasm as a response to traction, to record subjective assessments of the result of observations of a strengthening process in a journal, and, based on the accumulated information, to find the optimal ones: traction strength, types of exercises, duration of execution and number of repetitions.

The purpose of the present invention is to create the apparatus in the form of a mass-produced device with which any individual at any location could perform exercises to strengthen the muscular corset of the cervical spine under the action of the traction force. At the same time, the device should be extremely easy to use, devoid of all the disadvantages inherent in conventional devices.

Further areas of applicability of the present disclosure will become apparent from the detailed description, the claims and the drawings. The detailed description and specific examples are intended for purposes of illustration only and are not intended to limit the scope of the disclosure.

SUMMARY OF THE INVENTION

One aspect of the present invention provides a cervical spine and neck muscles strengthening apparatus, operable in an apparatus adjusting mode and a cervical spine and neck muscles strengthening mode.

According to a preferred embodiment of the invention the apparatus includes a traction control line, movably connected to a loop of a headgear formed by a first band through a first carabiner. The traction control line includes a first part and a second part connected by a second carabiner. The first part of the traction control line is a non-elastic cord configured for use in the apparatus adjusting mode. The first part of the traction control line is an elastic cord of the same length as the non-elastic cord configured for use in the cervical spine and neck muscles strengthening mode. The second part is a traction control line band made of wear-resistant fabric, configured to withstand repeated pinching by a movable support to a fixed support, and comprising at a first end a loop of the traction control line band configured to provide connection through the second carabiner to the first part of the traction control line. The apparatus further comprises a special spring configured to press the traction control line band against an edge of the movable support in the apparatus adjusting mode to allow controlled sliding of the band and automatic determination of a zero traction force point.

Another aspect of the present invention provides a method for producing the apparatus, said method includes the following steps:

producing and connecting the traction control line consisting of the traction control line band, the second carabiner, and the non-elastic cord, the elastic cord, the headgear consisting of the first band and a second band made of dense soft fabric, the first carabiner, and the special spring configured to press the traction control line band tightly to the edge of the movable support with the ability of controlled sliding of the traction control line band under the applied force;

wherein the first and second bands are provided with a plurality of fastener strips configured for adjustable interconnection of the bands and fastening of the headgear on a head;

determining an elastic force counteracting the stretching of the elastic cord based on predetermined calibration data established by testing a relationship between elongation and tensile force for said elastic cord;

choosing a sample of the elastic cord from among those commercially available through testing an absolute increase in the length of a stretched elastic cord necessary to achieve tensile forces equal to certain values;

reporting the values of said elongations and corresponding tensile forces for subsequent use when marking a force scale of the traction control line band starting from the zero traction force point.

Another aspect of the present invention provides a method for adjusting the traction force in the apparatus, said method includes the following steps:

initial adjusting of the apparatus in a location chosen for cervical spine and neck muscles strengthening, in front of the movable support, wherein adjusting the apparatus comprising the following steps:

connecting the loop of the headgear with a loop at a first end of the non-elastic cord through the first carabiner;

connecting a second end of the non-elastic cord with the loop of the traction control line band through the second carabiner;

configuring the headgear to be placed on a head by fastening the first band and a second band such that the first and second bands adjustably overlap at their respective ends and further intersect at lateral regions of the headgear, where the first and second bands are detachably secured to one another through said third and fourth pluralities of strips;

tightly fastening the second band of the headgear around the back region of the headgear through a first and a second plurality of strips, where a strip of a first plurality of strips sewn onto an inner surface of the second band comprises a plurality of loops and a strip of a second plurality of strips sewn onto an outer surface of the second band comprises a plurality of hooks;

tightly fastening the first band of the headgear near a cheek region of the headgear through the first and the second plurality of strips, where the strip of the first plurality of strips sewn onto an inner surface of the first band comprises a plurality of loops and the strip of the second plurality of strips sewn onto an outer surface of the first band comprises a plurality of hooks;

wherein, on the first step, a symmetrical arrangement of the strips made of synthetic fabric sewn to the second band and, on the second step, a symmetrical intersection of the first and the second bands connected through the third and fourth pluralities of strips in the lateral regions of the headgear are being determined manually and serve as a guideline for the correct placement of the headgear. The method further comprises lowering the headgear from a standing height to a seated height while the special spring allows the traction control line band to slide, thereby automatically determining the zero traction force point where the sliding ceases.

The method for adjusting further comprises setting a specific traction force by replacing the non-elastic cord with the elastic cord and fixedly pinching the traction control line band at a chosen mark of the force scale between the movable support and the fixed support.

Various other purposes and advantages of the invention will become clear from its description in the specification that follows and from the novel features particularly pointed out in the appended claims. Therefore, to the accomplishment of the objectives described above, this invention consists of the features hereinafter illustrated in the drawings, fully described in the detailed description of the preferred embodiments and particularly pointed out in the claims. However, such drawings and description disclose only some of the various ways in which the invention may be practiced.

BRIEF DESCRIPTION OF THE DRAWINGS

Other assemblies, systems, methods, apparatus, features, and advantages of the present invention will be apparent to one skilled in the art upon examination of the following figures and detailed description. Component parts shown in the drawings are not necessarily to scale, and may be exaggerated to better illustrate the important features of the present invention.

DETAILED DESCRIPTION OF THE INVENTION

Figure 1:
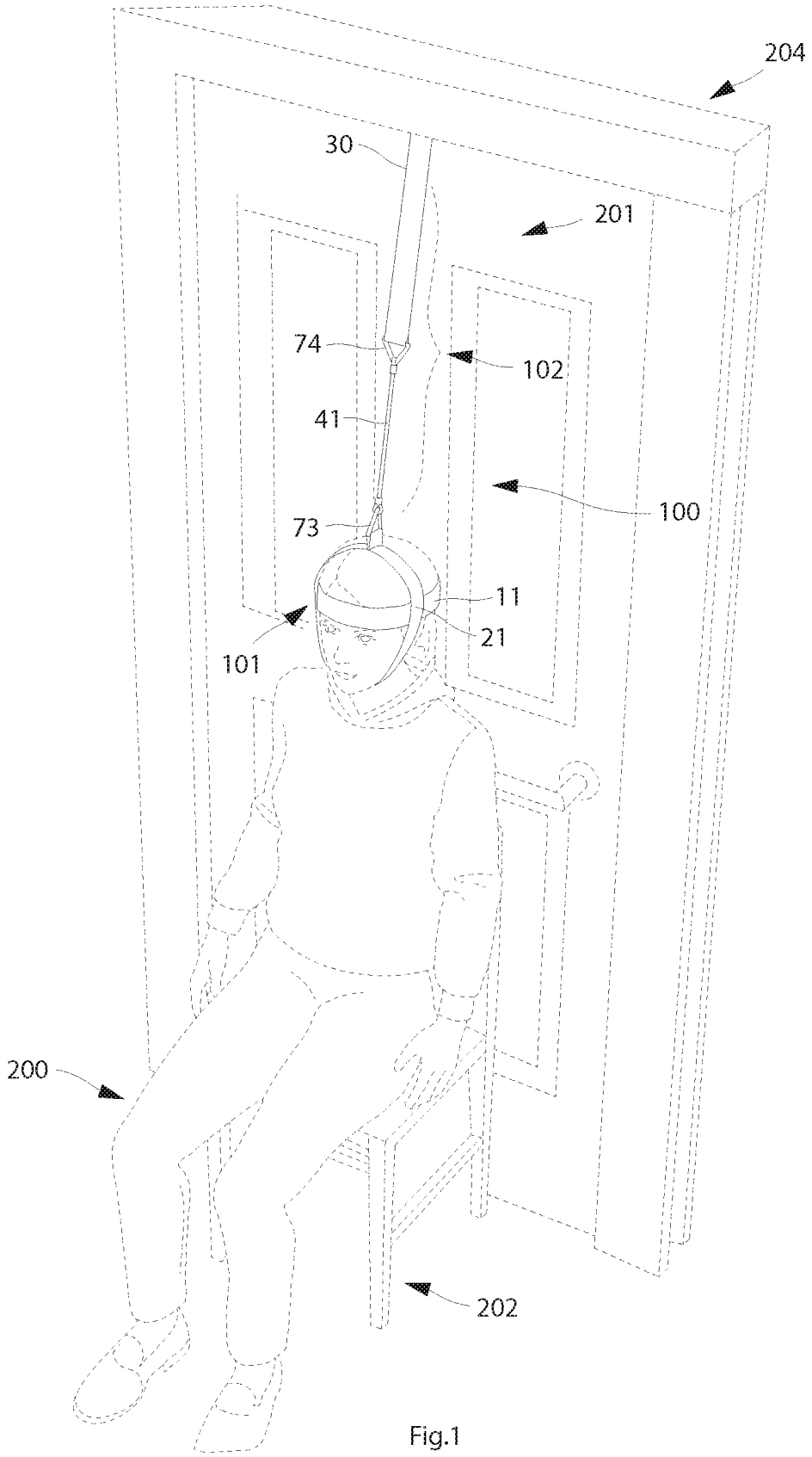
FIG. 1 is a perspective view of the cervical spine and neck muscles strengthening apparatus in the cervical spine and neck muscles strengthening mode attached to a door.
Figure 2:
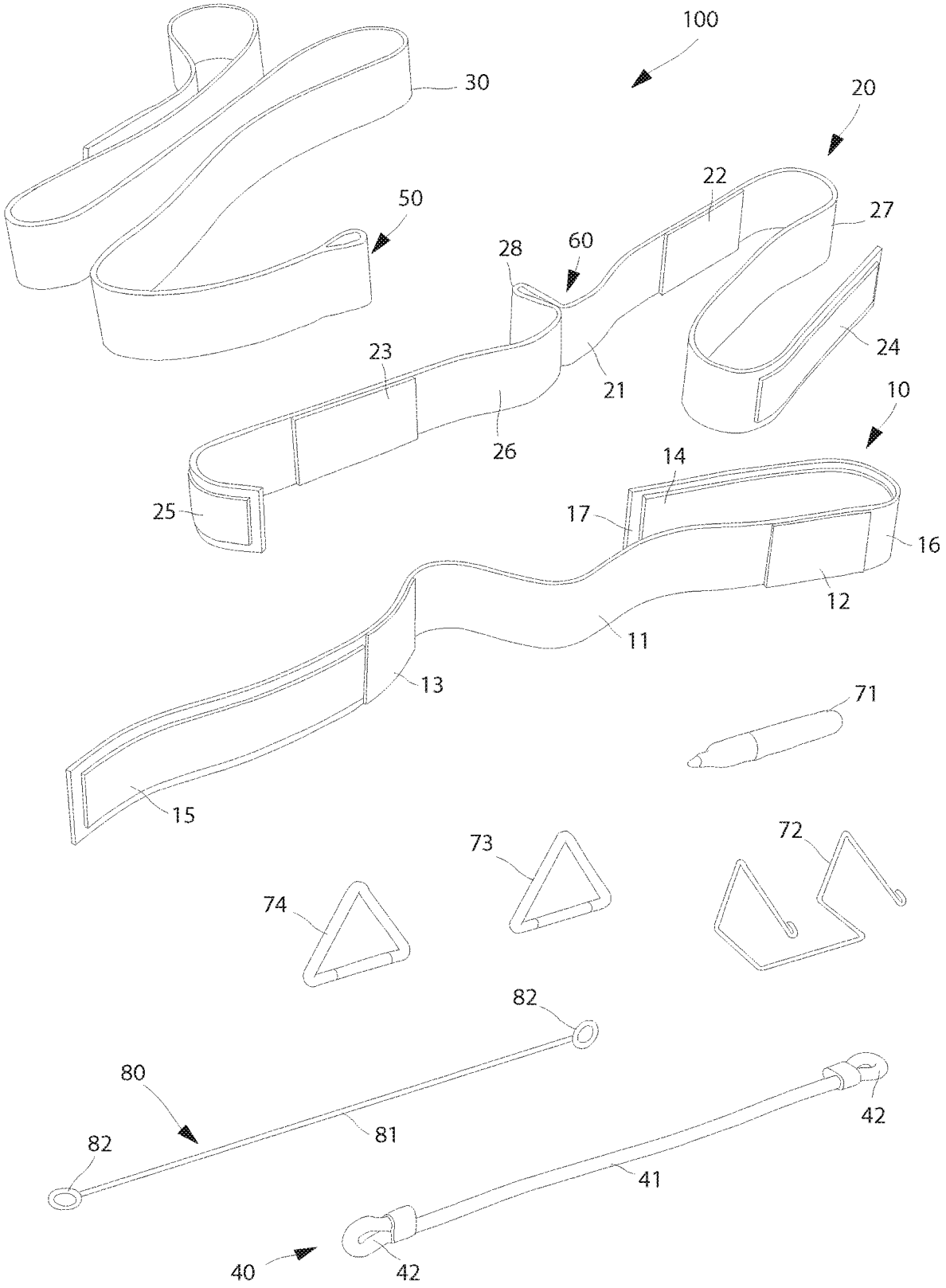
FIG. 2 is a perspective view of components included in the apparatus.
Figure 3:
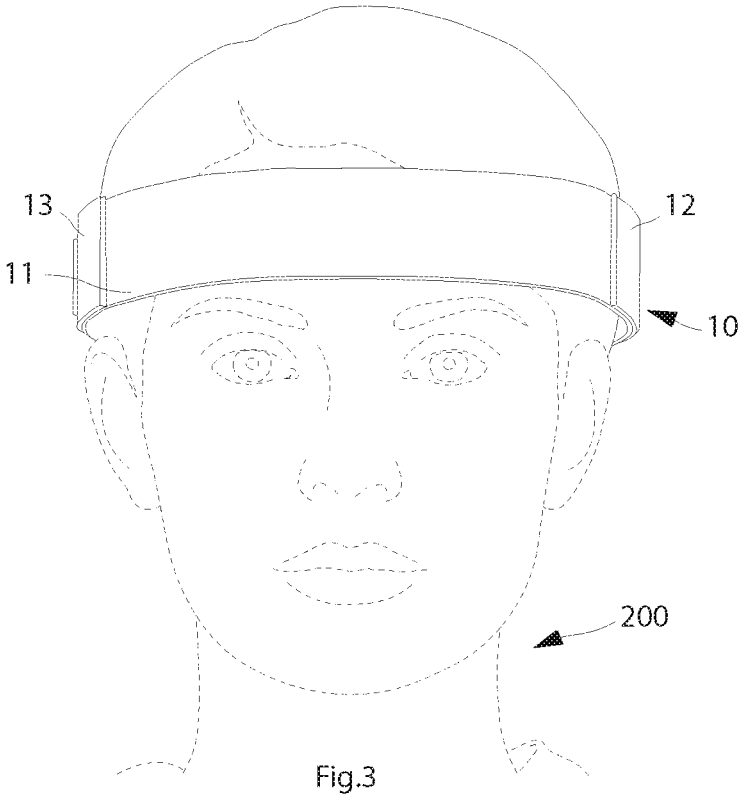
FIG. 3 is a front view of the headgear showing the second band.
Figure 4:
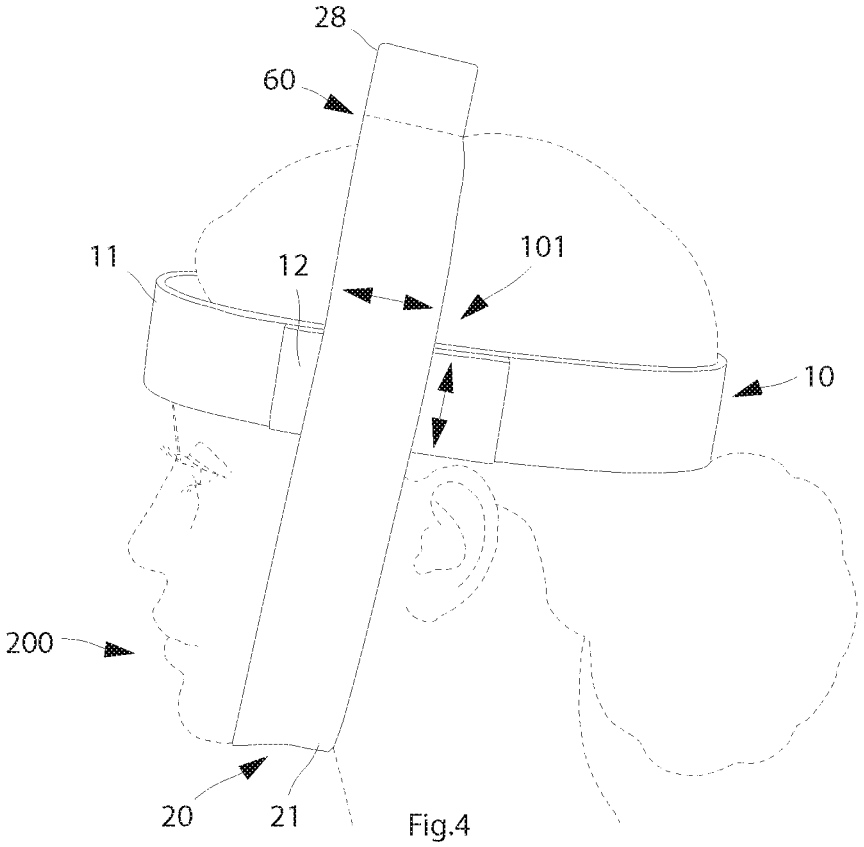
FIG. 4 is a left side view of the headgear configured to fit a head.
Figure 5:
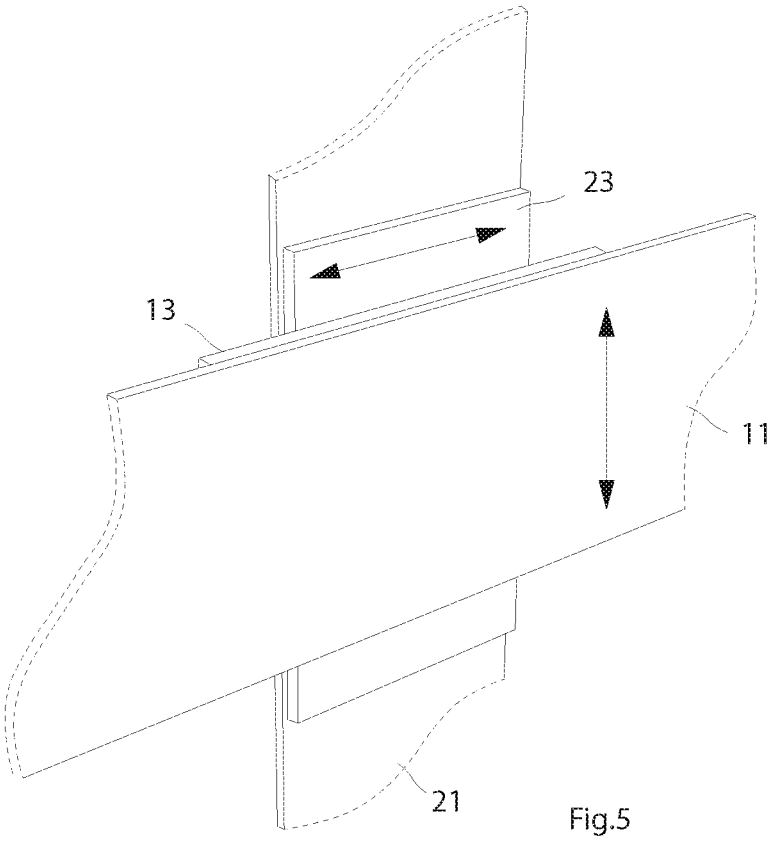
FIG. 5 is a partial inside view of the connection of the first band and the second band of the headgear in a right lateral region.
Figure 6:
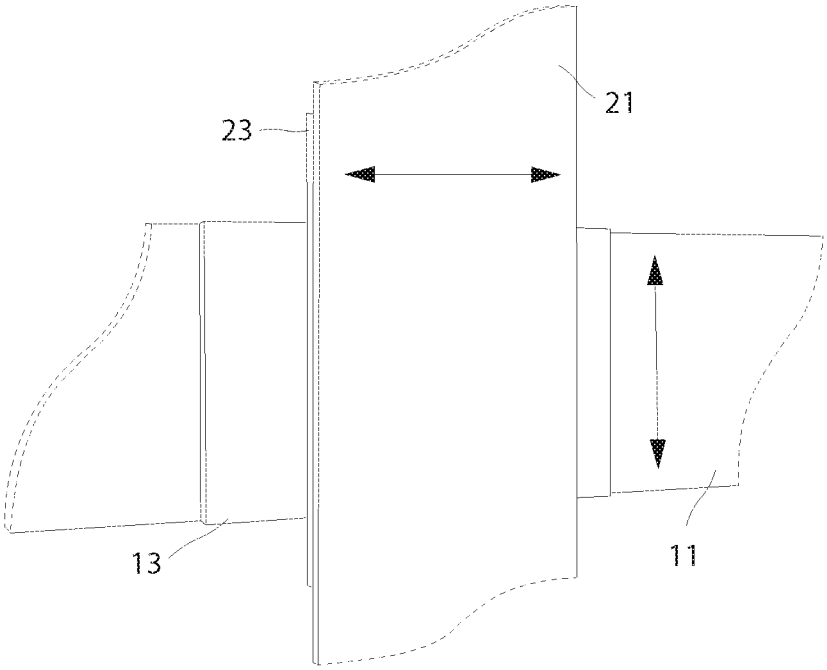
FIG. 6 is a partial outside view of the connection of the first band and the second band of the headgear in a right lateral region.
Figure 7:
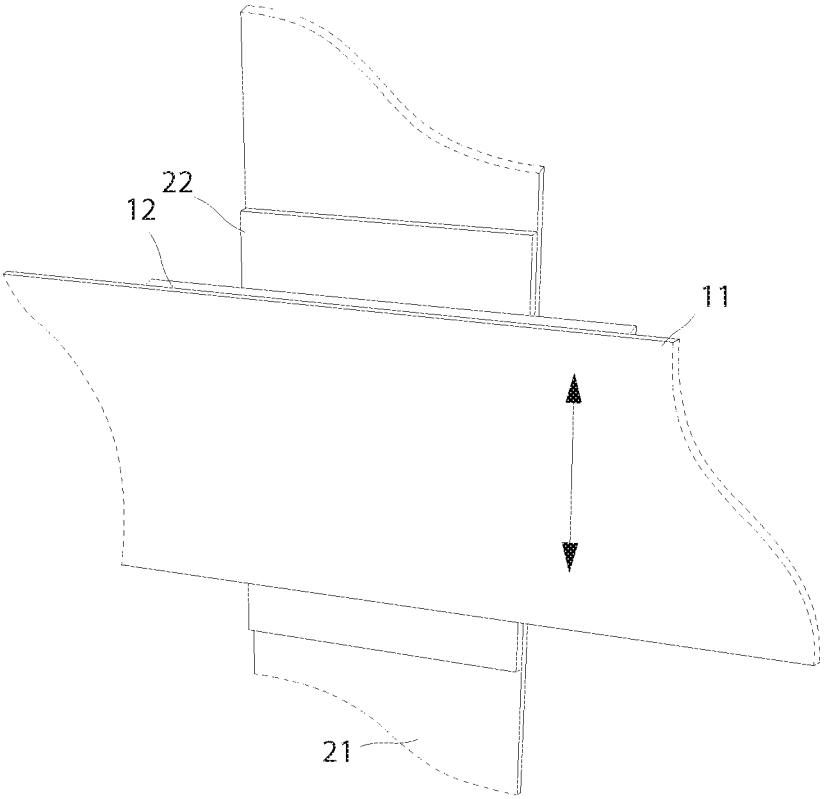
FIG. 7 is a partial inside view of the connection of the first band and the second band of the headgear in a left lateral region.
Figure 8:
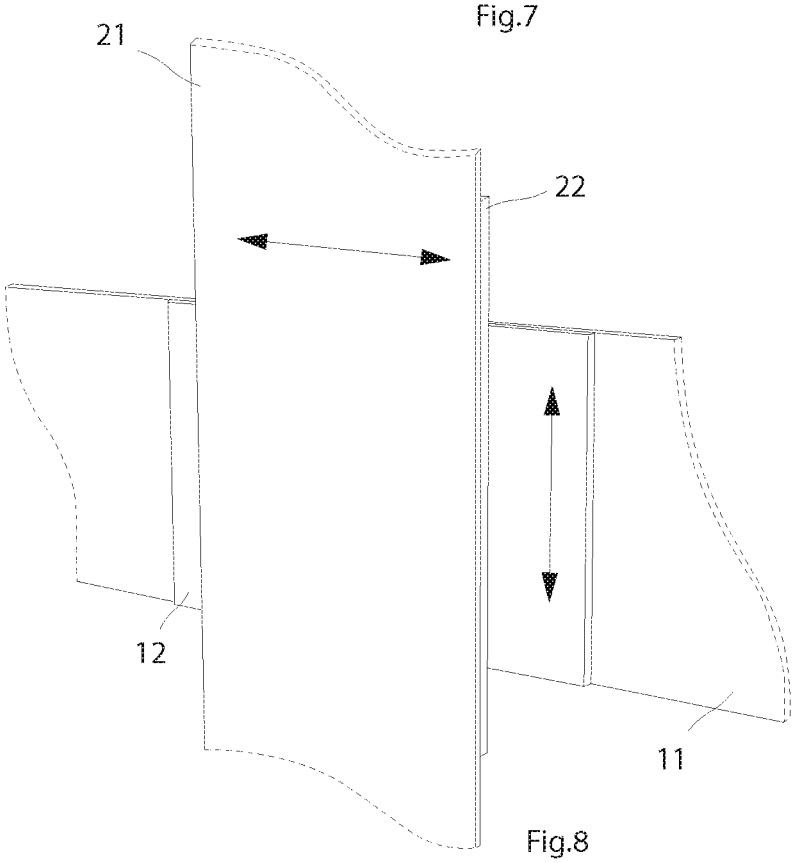
FIG. 8 is a partial outside view of the connection of the first band and the second band of the headgear in a left lateral region.
Figure 9:
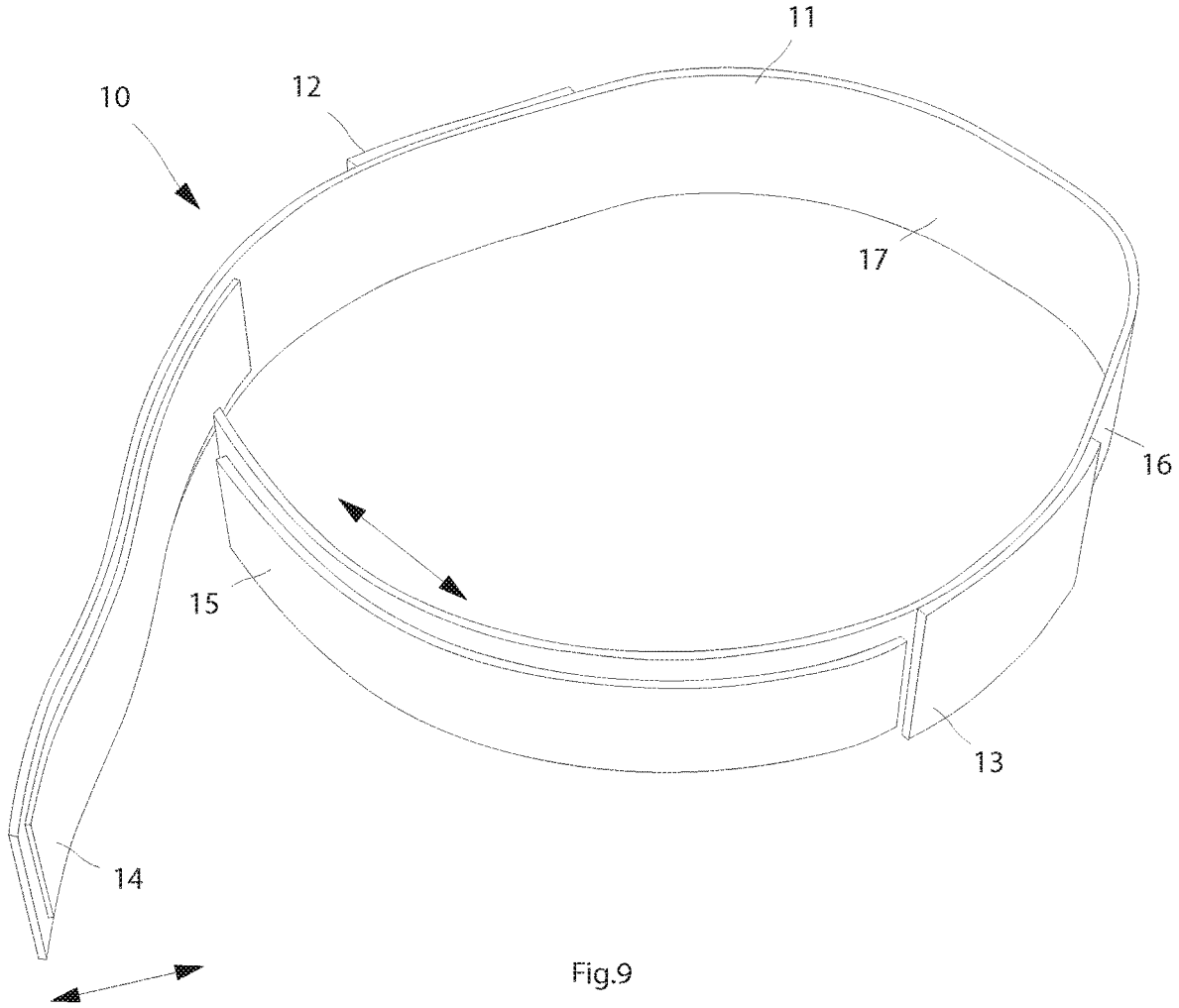
FIG. 9 is a perspective view of the second band of the headgear showing a plurality of ends of the second band, the design of which is applicable to the first band as well.

Certain embodiments commensurate in scope with the originally claimed subject matter are summarized below. These embodiments are not intended to limit the scope of the disclosure, but rather these embodiments are intended only to provide a brief summary of certain disclosed embodiments. Indeed, the present disclosure may encompass a variety of forms that may be similar to or different from the embodiments set forth below.

According to a preferred embodiment of the invention (FIGS. 1-20) a cervical spine and neck muscles strengthening apparatus 100 includes a headgear 101. An individual 200, a movable support 201, and a seat (e.g., a chair or a stool) 202 are shown in broken lines for illustrative purposes only and form no part of the claimed invention. The headgear 101 includes a first band 20 and a second band 10 made of dense soft fabric 21, 11 respectively configured to fit a head of the individual 200 in two planes and maintain its position during operation of the apparatus when the individual 200 performs physical exercises in the presence of a traction force applied to a loop 28 of the headgear 101 formed by the first band 20 configured to cover the head of the individual 200 from crown to chin. The second band 10 is configured to fit the head of the individual 200 along a forehead and a back of the head and maintain its position when the individual 200 performs physical exercises in the presence of the traction force applied to the loop 28 of the headgear 101.

The adaptability of the headgear 101 to heads of different shapes is ensured by the softness and flexibility of the bands 10 and 20. The adaptability of the headgear 101 to heads of different sizes is ensured by joining ends of the bands 10 and 20 with an overlap. The lengths of the band 10, sections of a plurality of loops 14 and a plurality of hooks 15 are chosen so that on the head of an average size sections of the plurality of loops 14 and the plurality of hooks 15 are overlapped on the back of the head along their entire length, and on heads of larger or smaller sizes they are displaced relative to each other while still maintaining a contact area large enough for reliable adhesion.

The lengths of the band 20, sections of a plurality of loops 24, and a plurality of hooks 25 are chosen so that on the head of an average size sections of the plurality of loops 24 and the plurality of hooks 25 are overlapped near the cheek region along their entire length and on heads of larger or smaller sizes they are displaced relative to each other while still maintaining a contact area large enough for reliable adhesion.

On a head of a small size, zones of the intersection of the bands 10 and 20, located in lateral regions of the headgear displace along segments 12 and 13 (a third plurality of strips 12 and 13 made of a first synthetic fabric with a plurality of hooks sewn onto an outer surface 16 of the band 10) in the direction of the forehead region, and on a large head, on the contrary, towards the back region. At the same time, a length of the segments 12 and 13 is large enough to provide a required contact zone of the two bands 10 and 20, both in the first and in the second cases.

Contact zones of the bands 10 and 20 in the lateral regions of the headgear are displaced along segments 22 and 23 (a fourth plurality of strips 22 and 23 made of a second synthetic fabric with a plurality of loops sewn onto an inner surface 26 of the band 20).

On a head of a small size, zones of intersection of the bands 10 and 20 are shifted along the segments 22 and 23 in the direction of the crown region, and on a head of a large size, vice versa, towards the chin region. At the same time, a length of the segments 22 and 23 is large enough to provide a required contact area of the two bands 10 and 20.

Ends of the band 20 are connected when fastening on the head through a first and a second plurality of strips.

The apparatus 100 includes a first carabiner 73 and a second carabiner 74.

The apparatus 100 includes a traction control line 102, movably connected to the loop 28 of the headgear 101 formed by the first band 20 through a first carabiner 73. The traction control line 102 includes a first part and a second part connected by a second carabiner 74. The first part of the traction control line 102 is a non-elastic cord 80 comprising a main body 81 and a plurality of loops 82 at its ends, configured for use in the apparatus adjusting mode. The first part of the traction control line 102 is an elastic cord 40 comprising a main body 41 and a plurality of loops 42 at its ends, the elastic cord 40 being of the same length as the non-elastic cord 80 configured for use in the cervical spine and neck muscles strengthening mode. The loops 42 and 82 are configured to connect with the carabiners 73 and 74. The second part is a traction control line band 30 made of wear-resistant fabric, configured to withstand repeated pinching by the movable support 201 against a fixed support 204, and comprising at a first end a loop 50 of the traction control line band configured to provide connection through the second carabiner 74 to the first part of the traction control line 102. Solely for the purpose of explaining the invention to a person having ordinary skill in the art, FIGS. 1, 16, 17, 18 display a door as the movable support 201 and a door frame as the fixed support 204.

A second end of the traction control line band 30 is installed in a frictional engagement in the apparatus adjusting mode and fixedly in the cervical spine and neck muscles strengthening mode. The frictional engagement allows for controlled sliding of the traction control line band 30 upon application of force while maintaining the traction control line in a taut state.

The apparatus 100 includes a special spring 72 configured to press the second end of the traction control line band 30 moving in the frictional engagement with the special spring 72 against an edge of the movable support 201 in the apparatus adjusting mode.

The special spring 72 is pressed against the edge of the movable support 201 with such a force as to create a frictional force when the traction control line band 30 moves under the special spring 72 during the apparatus adjusting mode. The frictional force is configured to maintain the traction control line, the loop 28 of the headgear 101 and the first band 20 in a well-taut state during controlled sliding of the traction control line band 30 until a zero traction force point is determined. In the cervical spine and neck muscles strengthening mode, the traction control line 102 is fixed by pinching the traction control line band 30 between the movable support 201 and the fixed support 204. If the door is chosen as the movable support 201, then the door frame is the fixed support 204.

A plurality of inner surfaces 26, 17 of the first 20 and the second 10 bands can be made in a color different from the color of a plurality of outer surfaces 27, 16 of the first 20 and the second 10 bands. Such coloring ensures the correct putting on of the headgear 101 on a head.

The first 20 and the second 10 bands can be made with inscriptions, location and direction of which can be configured to ensure the correct putting on of the headgear 101 on a head.

The first band 20 and the second band 10 can be made of a length that when wrapping the head, the first band 20 ends overlap each other over a length sufficient to ensure adhesion of a plurality of fasteners, and the second band 10 ends overlap each other over a length sufficient to ensure adhesion of a plurality of fasteners, regardless of the head size.

Figures 10, 11, 12:
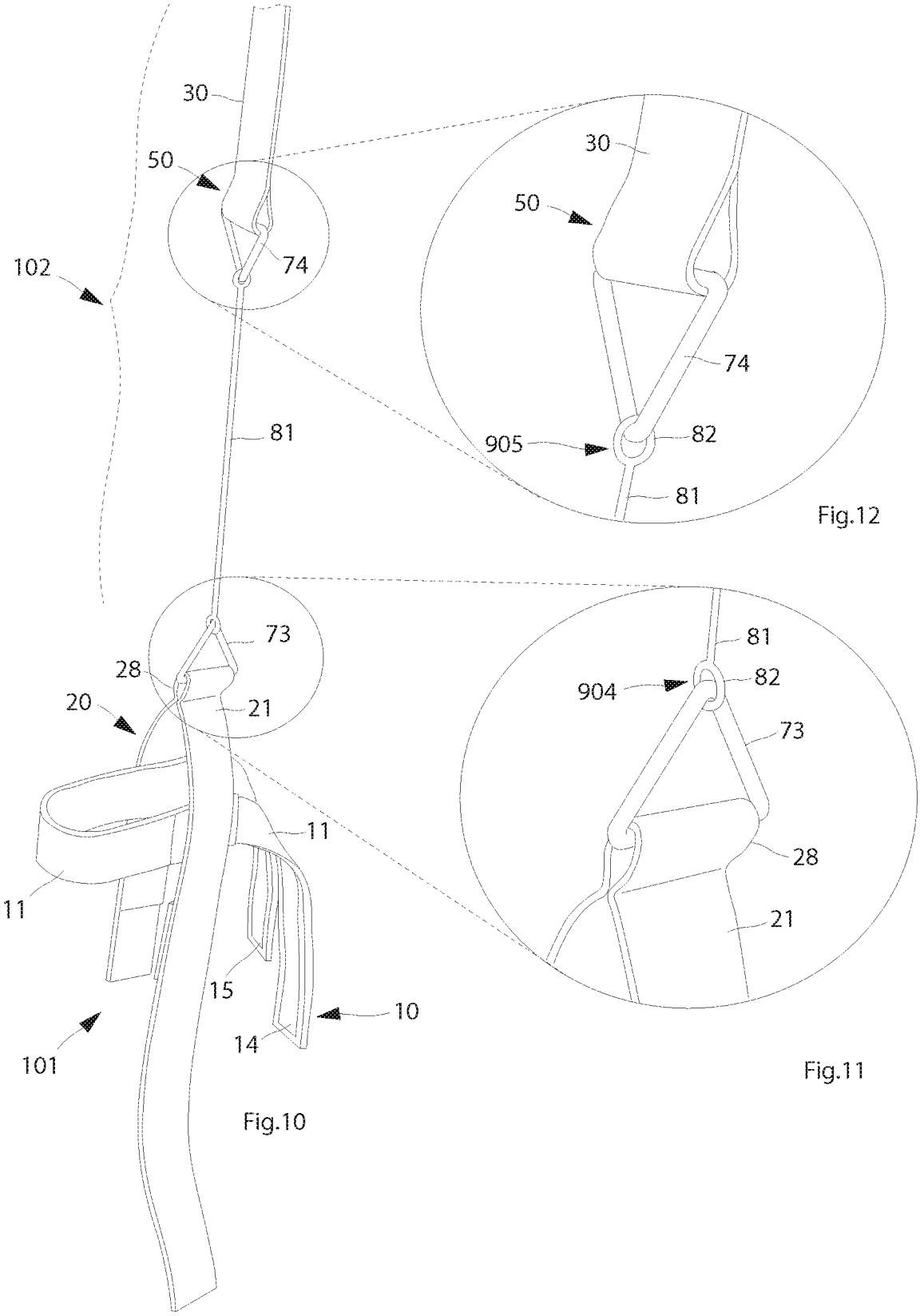
FIG. 10 is a perspective view of a connection of components of the traction control line configured for the apparatus adjusting mode.
FIG. 11 is an enlarged view of the connection between the headgear and the non-elastic cord through the first carabiner.
FIG. 12 is an enlarged view of the connection between the non-elastic cord and the traction control line band through the second carabiner.
Figures 13, 14, 15:
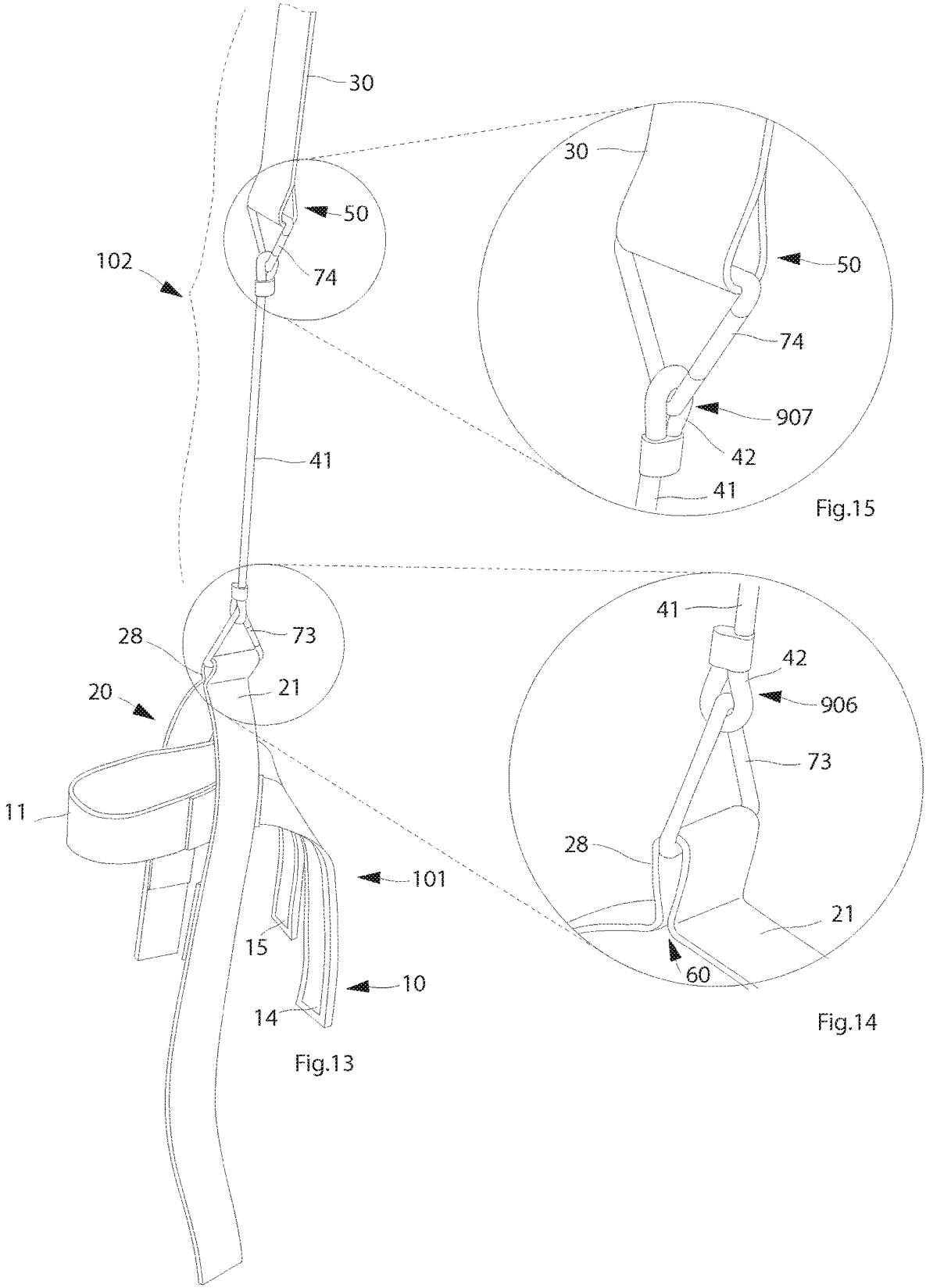
FIG. 13 is a perspective view of a connection of components of the traction control line configured for the cervical spine and neck muscles strengthening mode.
FIG. 14 is an enlarged view of the connection between the headgear and the elastic cord through the first carabiner.
FIG. 15 is an enlarged view of the connection between the elastic cord and the traction control line band through the second carabiner.
Figure 16:
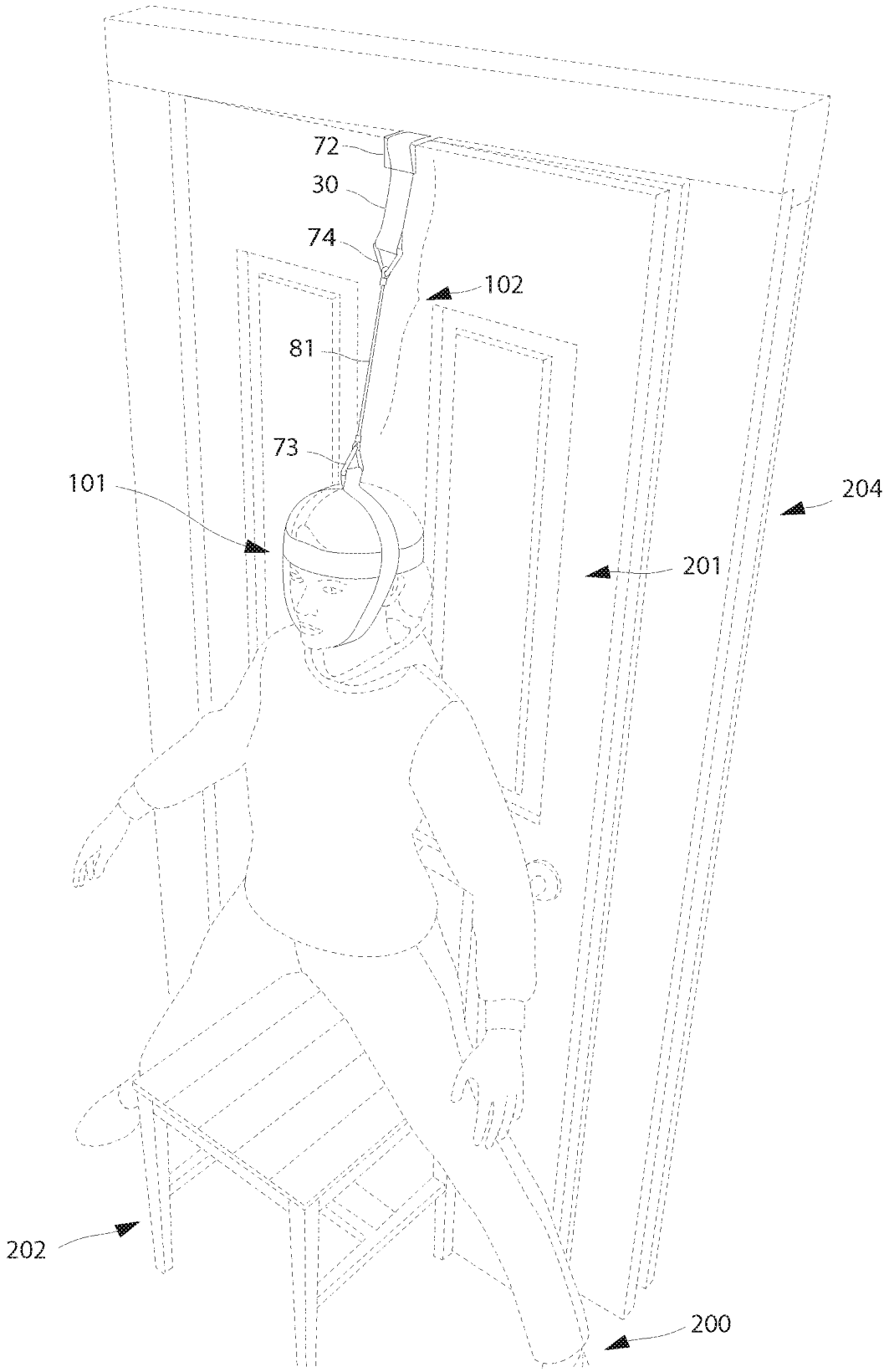
FIG. 16 illustrates a process of adjusting the apparatus in the apparatus adjusting mode.
Figure 17:
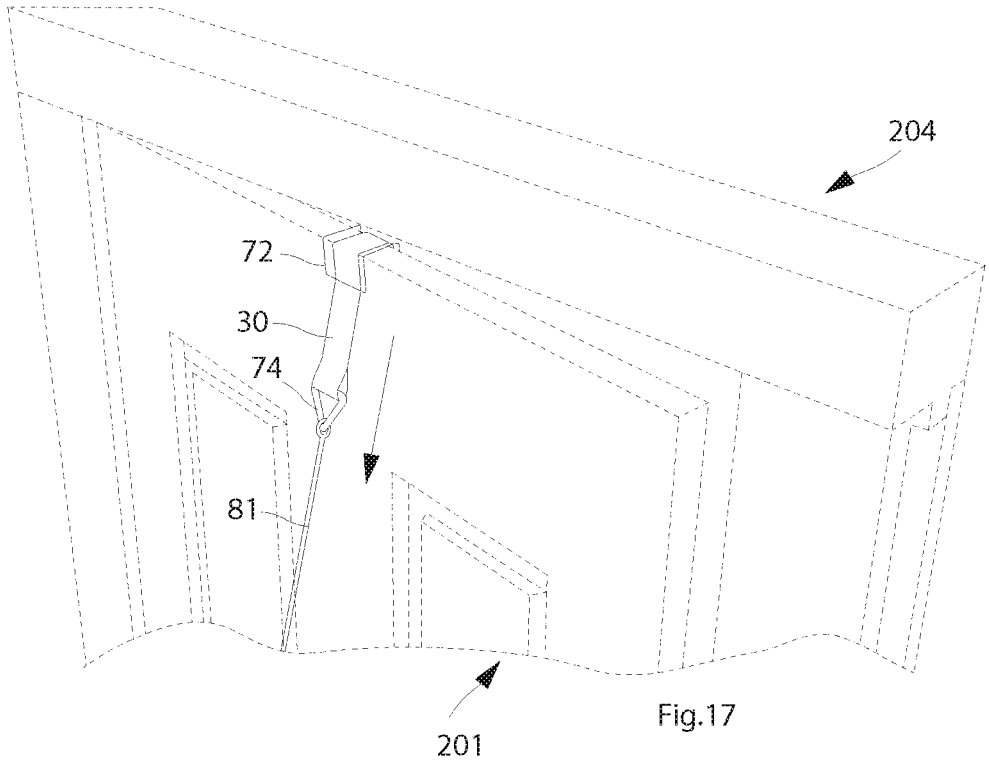
FIG. 17 is a partial enlarged view of FIG. 16.
Figure 18:
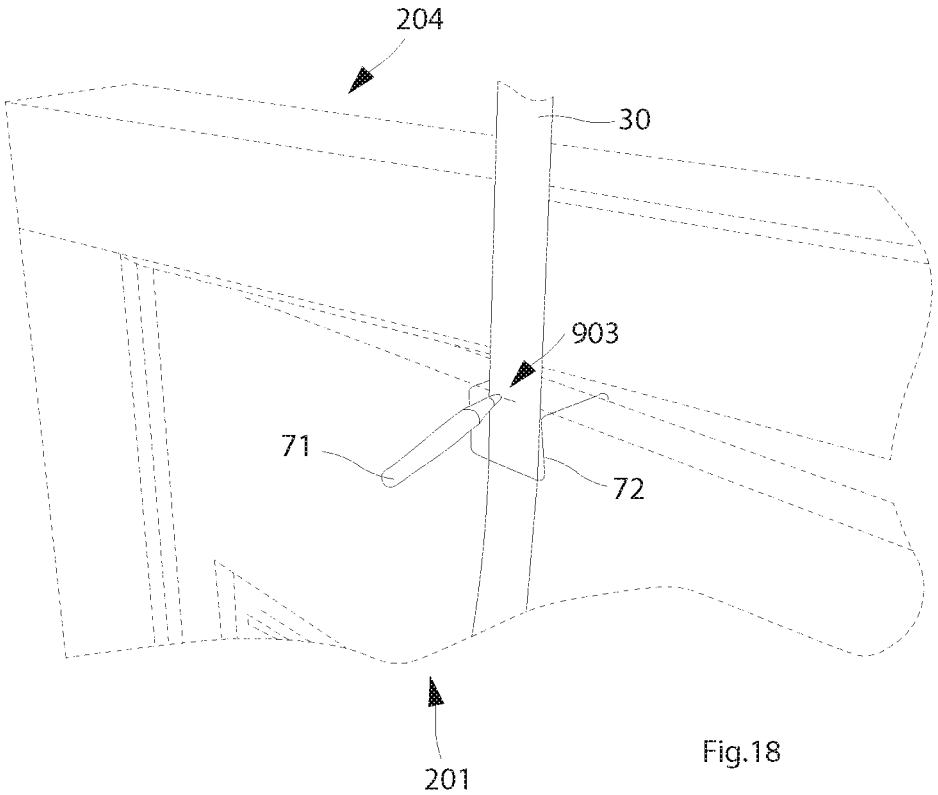
FIG. 18 is another partial enlarged view of FIG. 16 illustrating a process of initially marking the force scale starting from the zero traction force point.
Figure 19:
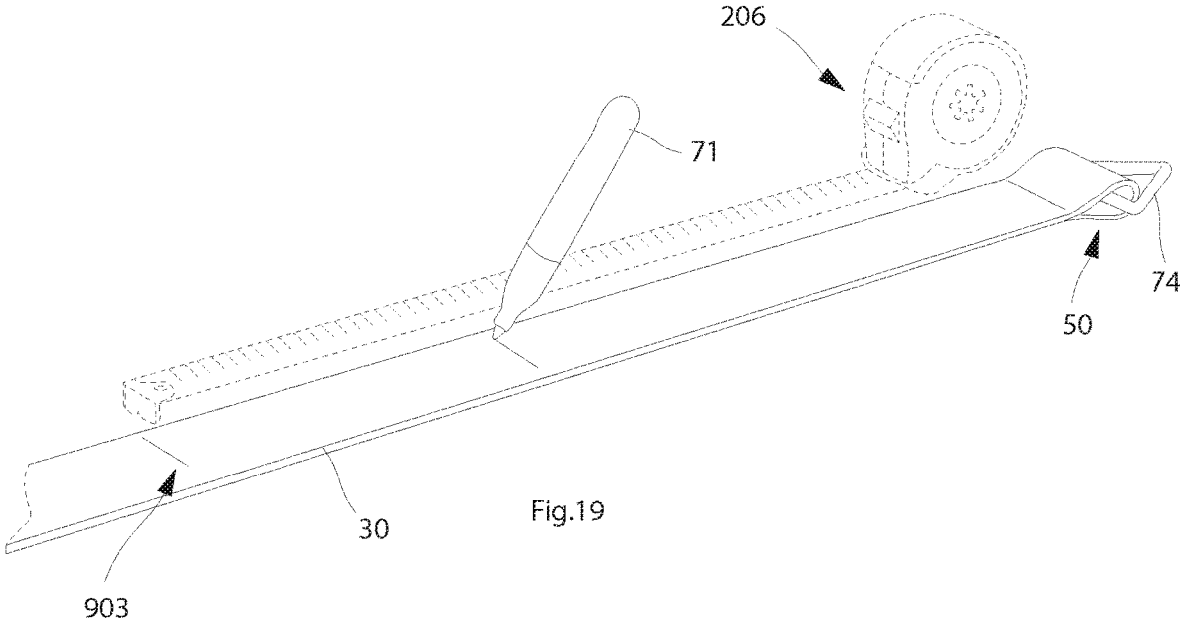
FIG. 19 illustrates a process of marking the force scale on the traction control line band.

At a point 60, the first band 20 is sewn in such a way that it forms the loop 28 of the headgear 101 of sufficient size to pass through it a connecting component of the first carabiner 73 (see FIG. 10). In use, the loop 28 of the headgear 101 is placed on the crown region of a head.

The apparatus 100 can additionally include a first plurality of strips 15 and 25 made of the first synthetic fabric with a plurality of hooks integrated into the fabric, sewn on outer surfaces 27, 16 of a first end of the first band 20 and a first end of the second band 10, and a second plurality of strips 14 and 24 made of the second synthetic fabric with a plurality of loops integrated into the fabric, sewn on inner surfaces 26, 17 of a second end of the first band 20 and a second end of the second band 10. Strong adhesion of the first and second pluralities of strips 14, 15, 24, 25 made of the first and second synthetic fabrics can be ensured. For example, "Velcro" synthetic fabrics can be used for such purposes. The connections of the first band 20 and the second band 10 can be configured to be detachable with an application of force.

The first band 20 can be configured for fastening near the cheek region of the headgear through the first and second pluralities of strips. Said strip with the plurality of loops sewn onto the inner surface 26 of the first end of the first band 20 can be configured to provide connection with said strip with the plurality of hooks sewn onto the outer surface 27 of the second end of the first band 20. The first band 20 can be configured for a natural tight fit to any head shape.

The second band 10 of the headgear 101 can be configured for fastening around the back region of the headgear through the first and second pluralities of strips. Said strip with the plurality of loops sewn onto inner surface 17 of the first end of the second band 10 can be configured to provide connection with said strip with the plurality of hooks sewn onto the outer surface 16 of the second end of the second band 10. The second band 10 can be configured for a natural tight fit to any head shape.

The apparatus 100 can additionally include the loop 28 of the headgear 101 sewn on the first band 20 for translating the traction force to the headgear when the headgear is worn.

The apparatus 100 can additionally include silicone coating applied to the inner surfaces 26, 17 of the first 20 and the second 10 bands. Silicone coating can be coated in such a way as to maintain air and water permeability of the first 20 and the second 10 bands.

The apparatus 100 can additionally include the third plurality of strips 12 and 13 made of the first synthetic fabric with a plurality of hooks integrated into the first synthetic fabric sewn onto the outer surface 16 of the second band 10 in the areas of its intersection with the first band 20 in the lateral regions of the headgear. The length of the strips 12 and 13 significantly exceeds the width of the first 20 and the second 10 bands, and the places of sewing are chosen in such a way that when fastening the first 20 and the second 10 bands on a head of any shape and size, the first band 20 with a fourth plurality of strips made of the second synthetic fabric with the plurality of loops always crosses the second band 10 within said third plurality of strips 12 and 13 made of the first synthetic fabric with the plurality of hooks.

The elastic cord 40 can be made of a bundle of rubber or latex threads in a fabric braid which provides stretching up to 200% of its original length. The elastic cord 40 can be a body in which, during tension, an elastic deformation and the elastic force counteracting the stretching occur the value of which is determined based on a predetermined relationship between elongation and tensile force established for said elastic cord.

The elastic cord 40 can be made of a single piece of rubber or latex of any section shape. The elastic cord 40 can be a body in which, during tension, the elastic deformation and the elastic force counteracting the stretching occur, the value of which is determined based on a predetermined relationship between elongation and tensile force established for said elastic cord.

The use of the bands 10 and 20 comprising the first, second, third and fourth pluralities of strips provides a tight coverage of the head of any size and shape, as well as maintaining the position of the point of application of the traction force and resistance during the spine and neck muscles strengthening process.

A method for producing the spine and neck muscles strengthening apparatus 100 includes the following steps:

- producing the headgear 101 comprising the first band 20 and the second band 10;
- producing the traction control line 102 comprising the traction control line band 30, the first carabiner 73, the second carabiner 74, and the first part selected from the group consisting of the non-elastic cord 80 and the elastic cord 40;
- providing the special spring 72 configured to press the traction control line band 30 against an edge of the movable support 201 to allow controlled sliding of the traction control line band during a height adjustment of the headgear, thereby enabling the determination of the zero traction force point where the sliding ceases;
- determining the elastic force counteracting the stretching of the elastic cord based on predetermined calibration data established by testing a relationship between elongation and tensile force for said elastic cord;
- choosing a sample of the elastic cord 40 from among those commercially available
- through testing an absolute increase in the length of a stretched elastic cord 40 necessary to achieve tensile forces equal to certain values.
- reporting the values of said elongations and corresponding tensile forces for subsequent use when marking a force scale of the traction control line band 30 starting from the zero traction force point.

Wherein traction control is carried out by changing the ratio of the lengths of the traction control line 102, elastic in the form of the elastic cord 40, and non-elastic in the form of the traction control line band 30, under conditions of invariance of the total distance from the point of application of the traction force to the loop 28 of the headgear 101 configured to be worn on a head, placed on the edge of the movable support 201 pinching the traction control line band 30 to the fixed support 204 at a chosen mark of the force scale.

A method for adjusting the traction force in the apparatus 100 includes the following steps:

- initial adjusting of the apparatus 100 in a location chosen for cervical spine and neck muscles strengthening, in front of the movable support 201, wherein adjusting the apparatus 100 includes the following steps:
- connecting the loop 28 of the headgear 101 with the loop at the first end of the non-elastic cord 80 through the first carabiner 73;
- connecting the second end of the non-elastic cord 80 with the loop 50 of the traction control line band through the second carabiner 74;
- configuring the headgear 101 to be placed on a head by fastening the first band 20 and the second band 10 such that the third and fourth pluralities of strips intersect at lateral regions of the headgear;
- tightly fastening the second band 10 of the headgear 101 through the first and second pluralities of strips;
- tightly fastening of the first band 20 of the headgear 101 through the first and second pluralities of strips.

Wherein, on the first step, the symmetrical arrangement of the third plurality of strips 12 and 13 made of synthetic fabric sewn to the second band 10 and, on the second step, symmetrical intersection of the first 20 and the second 10 bands connected through said strips in the lateral regions of the headgear is being determined manually and serves as a guideline for the correct placement of the headgear 101. The said bands are connected by pressing them in the lateral regions.

The method for adjusting further comprises:

- locking the movable support 201 in an open position relative to the fixed support 204 adjacent to the movable support 201;
- positioning the seat 202 directly in front of the movable support 201;
- transferring the traction control line band 30 over the movable support 201 above the seat) 202;
- pressing the traction control line band 30 against an edge of the movable support 201 using the special spring 72, wherein the special spring is clamped over the edge of the movable support with a clamping portion of the spring positioned across the traction control line band 30;
- lowering the headgear 101 from a first vertical position corresponding to a standing height to a second vertical position corresponding to a seated height on the seat 202;
- maintaining the traction control line 102 in a taut state during the lowering by allowing the traction control line band 30 to slide under a friction resistance created by the special spring 72 against the edge of the movable support 201;

stopping the lowering of the headgear when the second vertical position is reached, whereby the sliding of the traction control line band 30 under the special spring 72 ceases, thereby automatically determining the zero traction force point of the traction control line band 30 relative to the edge of the movable support 201;

releasing the ends of the first 20 and the second 10 bands of the headgear 101;

moving the headgear 101 such that the position of the traction control line band 30 with respect to the edge of the movable support 201 is not changed;

drawing with a marker 71 an initial mark 903 for regulating the traction force on the traction control line band 30 in the place of its passage over the edge of the movable support 201 at a location corresponding to the edge of the movable support 201 at said zero traction force point;

removing the special spring 72 and releasing the traction control line band 30;

transferring the apparatus 100 for further drawing the force scale on the traction control line band 30 for regulating the traction force starting from the initial mark 903.

Wherein, in one embodiment of the invention, the method for adjusting the traction force in the apparatus 100 includes the following steps:

using a ruler or a measuring tape 206, the individual is drawing on the traction control line band 30 marks of the scale of traction force based on predetermined calibration data. Wherein the marking is made starting from the initial mark 903 in the direction of the loop 50 of the traction control line band and the first part of the traction control line depending on which of said cords is attached to the traction control line band 30 at that moment;

repeating the procedure of the adjustment of the traction force for different heights of the headgear, for another place of use if the height of the movable support 201 at that place is different from said movable support, if the height of the seat 202 at that place is different from said seat.

wherein for each height and each place of use a unique force scale is marked and subsequently used, marked in such a way that it can be easily identified;

wherein the unique force scale is applied to both sides along the traction control line 102, two scales on each side of the traction control line band 30;

wherein two force scales are applied on each side of the traction control line band 30 on different bands, in case the apparatus 100 is equipped with several traction control line bands 30;

setting the traction force accurately before starting cervical spine and neck muscles strengthening by fixing the traction control line band 30 at a corresponding mark drawn on the force scale by pinching the traction control line band 30 in such a way as the mark is on the edge of the movable support 201 between the movable support 201 and the fixed support 204.

Figure 20:
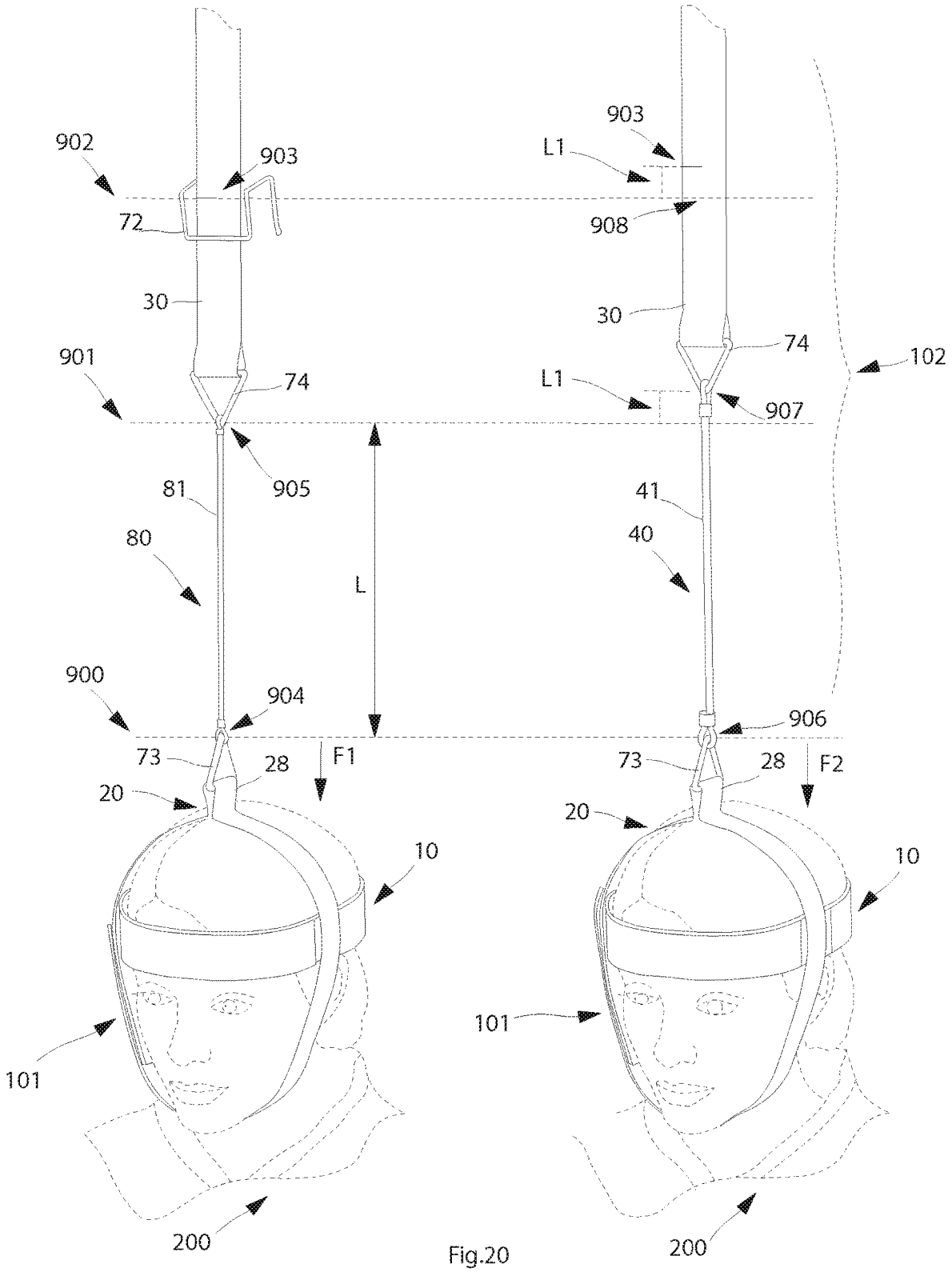
FIG. 20 illustrates a conceptual relationship between the elongation of the elastic cord 40 and the resulting traction force relative to the zero traction force point.

FIG. 20 illustrates a conceptual relationship between the elongation of the elastic cord 40 and the resulting traction force relative to the zero traction force point. The figure schematically compares the non-elastic cord 80 and the elastic cord 40 to illustrate the determination of the zero traction force point and the subsequent formation of the force scale based on predetermined calibration data.

The cords 80 and 40 have the same length L measured between centers of loops 904 and 905, 906 and 907, respectively. Wherein said loops have the same inner diameter, slightly larger than the outer diameter of rods of carabiners 73 and 74.

At the final stage of adjusting the apparatus 100, when the headgear 101 is lowered to the seated height and the traction control line band 30 is no longer pulled out from under the special spring 72, a weight of the head and components directed downwards is counterbalanced by the frictional engagement. In this case, the band 20 and the loop 28 of the headgear 101 are in the taut state, and a center of the lower loop 904 of the non-elastic cord 80 is at a level 900 which later, after replacing the non-elastic cord 80 with the elastic cord 40, is considered as a level reaching of which by a center of the lower loop 906 of the elastic band 40 is a sign of a creation of a traction force F1 in the traction control line 102. Although technically equal to the static friction force (F1) required to maintain the assembly in a taut state, this initial force is negligible compared to the forces used during strengthening and is thus defined as the zero traction force point for calibration purposes.

After removing the headgear 101, the band 30 does not change its position relative to the movable support 201, the edge of which is at a level 902. The initial mark 903 is applied to the band 30 at the level 902.

After replacing the non-elastic cord 80 in the traction control line 102 with the elastic cord 40, in order to set a target traction force F2, the elastic cord 40 is stretched until the center of the lower loop 906 of the elastic cord 40 reaches the same level 900 on which the loop 904 of the non-elastic cord 80 was in the process of adjusting the apparatus 100, and an upper loop 907 of the elastic cord 40 passes a distance L1 above a level 901 which was taken by the loop 905 of the non-elastic cord 80 in the process of adjusting the apparatus 100 and which would correspond to the original position of the loop 907 if the cord 40 had not been stretched and had a length L. The elongation L1 corresponds to the target traction force F2 according to the predetermined calibration data.

The same distance L1 relative to a level 902 the initial mark 903 is shifting and at the level 902 a conditional mark 908 is created the distance L1 to which from the initial mark 903 is created by the traction force F2. Such a distance is in full accordance with the force scale which is applied to the traction control line band 30 in accordance with an operation manual when marking it based on the predetermined calibration data.

The application of the force scale to the band 30 allows the traction force to be accurately set when the band 30 is properly positioned and pinched against the edge of the movable support 201.

According to one of a plurality of methods of using the apparatus 100, the exercises are performed with gradually increasing traction forces to enhance muscular endurance. The individual can perform slow head turns to the left and right. A record of the applied traction force, number of repetitions, and duration of training can be maintained to track the strengthening progress.

According to one of a plurality of methods of using the apparatus, the following actions can be performed: giving the head a straight initial position in a state of relaxation; maximally turning the head to the left; maximally lowering the head down until a natural muscular resistance is reached; lifting and returning the head to its initial position; maximally lowering the head down until a natural limit of motion is reached and returning to the initial position; maximally turning the head to the right; lowering the head down until a muscular limit is reached; lifting and returning the head to the initial position; repeating the cycle until muscle fatigue is reached.

Training the deep muscles of the neck may consist of the following sequence: giving the head a straight initial position in a state of relaxation; tilting the head to the left until a natural limit of mobility is reached; returning the head to the initial position and relaxing for 1-2 seconds; tilting the head to the right until the natural limit of mobility is reached; returning the head to the initial position and relaxing for 1-2 seconds; repeating the cycle.

Training the deep muscles of the neck may consist of the following sequence: giving the head a straight initial position in a state of relaxation; turning the head to the left until a maximum comfortable range of motion is reached; holding the head in the most turned position for 10-12 seconds; returning the head to the initial position and relaxing for 1-2 seconds; turning the head to the right until the maximum comfortable range of motion is reached; holding the head in the most turned position for 10-12 seconds; returning the head to the initial position and relaxing for 1-2 seconds; repeating the cycle.

According to one of a plurality of methods of using the apparatus, the following actions can be performed: giving the head a straight initial position in a state of relaxation; raising the arms up; folding the arms with palms to each other above the head; maximally abducting the elbows back; turning the head to the left until a natural muscular limit is reached; holding the head and the arms in the position for 10-12 seconds; returning the head and the arms to the initial position and relaxing for 1-2 seconds; raising the arms up; folding the arms with palms to each other above the head; maximally abducting the elbows back; turning the head to the right until the natural muscular limit is reached; holding the head and arms in the position for 10-12 seconds; returning the head and the arms to the initial position and relaxing for 1-2 seconds; repeating the cycle.

According to one of a plurality of methods of using the apparatus, the following actions can be performed: giving the head a straight initial position in a state of relaxation; raising arms to the sides; holding arms in a horizontal position outstretched to the sides for 10-12 seconds; returning the arms to the initial position and relaxing for 1-2 seconds; repeating the cycle.

According to one of a plurality of methods of using the apparatus, the following actions can be performed: giving the head a straight initial position in a state of relaxation; stretching the head forward and upward until a limit of motion is reached; returning the head to the initial position and relaxing for 1-2 seconds; lowering the head while simultaneously moving it back until a muscular resistance is reached; returning the head to the initial position and relaxing for 1-2 seconds; repeating the cycle.

According to one of a plurality of methods of using the apparatus, the following actions can be performed: giving the head a straight initial position in a state of relaxation; stretching the head forward and upward until a natural limit is reached; lowering the head extended forward down and to the left with the maximum approach of the chin to the shoulder; returning the head to the initial position; stretching the head forward and upward until the natural limit is reached; lowering the head extended forward down and to the right with the maximum approach of the chin to the shoulder; returning the head to the initial position; repeating the cycle.

Thus, features and embodiments specified above allow the apparatus to achieve the following effects:

- a low manufacturing cost, which makes the apparatus available to the general public;
- the possibility of use of the apparatus in any place having a suitable movable support;
- the ability to quickly, within a minute, set the required traction force and adjust the apparatus;
- a one-time adjustment of the force scale of the apparatus for a specific setup;
- a smooth application and removal of the traction force due to the elasticity of the cord;
- an ability to use the apparatus at home by various family members, for heads of different sizes, while maintaining the advantages of the apparatus in terms of quick installation and adjustment for each individual, regardless of the height of the individual or the head shape;
- an extremely compact and light weight of the apparatus, which allows the individual to take it to a new place or on a trip;
- free hands, which is extremely important, since the hands are used for performing strengthening movements;
- arms and legs do not take part in the creation of the traction force, since otherwise it would be impossible to achieve complete relaxation of the neck muscles;
- the minimum time for installation and adjustment of the required traction force is significantly reduced;
- safety of use, since a dangerous tensile force cannot be reached under any circumstances.

While only certain features and embodiments of the disclosure have been illustrated and described, many modifications and changes may occur to those skilled in the art without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosed embodiments. Furthermore, in an effort to provide a concise description of the exemplary embodiments, all features of an actual implementation may not have been described. It should be appreciated that in the development of any such actual implementation, as in any engineering or design project, numerous implementation-specific decisions may be made. Such a development effort might be complex and time-consuming, but would nevertheless be a routine undertaking of design, fabrication, and manufacture for those of ordinary skill having the benefit of this disclosure, without undue experimentation.

What is claimed is:

1. A cervical spine and neck muscles strengthening apparatus, operable in an apparatus adjusting mode and a cervical spine and neck muscles strengthening mode, comprising:

- a headgear comprising a first band and a second band made of dense soft fabric, the headgear configured to fit a head in two planes and maintain its position during operation of the apparatus in the presence of a traction force applied to a loop of the headgear formed by the first band, the first band further configured to cover the head from crown to chin;
- wherein the second band is configured to fit the head along a forehead and a back of the head;
- a first carabiner and a second carabiner;

a traction control line comprising a first part and a second part connected by the second carabiner, the traction control line movably connected to the loop of the headgear through the first carabiner;

wherein the first part of the traction control line is selected from the group consisting of:

a non-elastic cord configured for use in the apparatus adjusting mode, and an elastic cord of the same length as the non-elastic cord configured for use in the cervical spine and neck muscles strengthening mode;

wherein the second part is a traction control line band made of wear-resistant fabric, configured to withstand repeated pinching by a movable support against a fixed support, and comprising at a first end a loop of the traction control line band configured to connect through the second carabiner to the first part of the traction control line;

wherein a second end of the traction control line band is installed in a frictional engagement with an edge of the movable support in the apparatus adjusting mode, and fixedly between the movable support and the fixed support in the cervical spine and neck muscles strengthening mode;

a special spring configured to press the second end of the traction control line band against the edge of the movable support in the apparatus adjusting mode;

wherein the special spring provides a frictional force sufficient to maintain the traction control line in a taut state while allowing the traction control line band to slide under the special spring upon application of a force.

2. The apparatus of claim 1, wherein the first and second bands are of a length configured to circumferentially overlap when the headgear is worn, the overlap occurring over a length sufficient to ensure adhesion of a plurality of fasteners regardless of head size.

3. The apparatus of claim 2, further comprising: a first plurality of strips made of a first synthetic fabric with a plurality of hooks integrated into the fabric, sewn on outer surfaces of a first end of the first band and a first end of the second band;

and a second plurality of strips made of a second synthetic fabric with a plurality of loops integrated into the fabric, sewn on inner surfaces of a second end of the first band and a second end of the second band;

wherein strong adhesion of the first and second pluralities of strips is ensured;

wherein the connections of the first band and the second band are configured to be detachable with an application of force.

4. The apparatus of claim 3, wherein the first band is configured to be fastened near a cheek region of the headgear, and the second band is configured to be fastened around a back region of the headgear through the first and second pluralities of strips, wherein the first and second bands are configured for a natural tight fit to any head shape.

5. The apparatus of claim 3, further comprising the loop of the headgear sewn on the first band for translating a traction force to the headgear when the headgear is worn.

6. The apparatus of claim 3, further comprising:

a third plurality of strips made of the first synthetic fabric with the plurality of hooks sewn onto an outer surface of the second band in lateral regions of the headgear;

a fourth plurality of strips made of the second synthetic fabric with the plurality of loops sewn onto an inner surface of the first band in lateral regions of the headgear;

wherein a length of said third and fourth pluralities of strips is greater than a width of the first and second bands, providing a contact zone where the first band intersects the second band regardless of head size;

wherein the third and fourth pluralities of strips are configured to detachably connect the first and second bands and maintain their intersection during operation of the apparatus under application of the traction force;

and wherein the placement of the hooks on the outer surface of the second band and the loops on the inner surface of the first band is configured to prevent entanglement of hair by ensuring that any exposed portions of the strips facing a head consist of the plurality of loops.

7. The apparatus of claim 1, wherein the elastic cord is selected from the group consisting of: a bundle of rubber or latex threads in a fabric braid, and a single piece of rubber or latex of any section shape;

wherein the elastic cord provides stretching up to 200% of its original length, and wherein during tension, an elastic force occurs, the value of which is determined based on a predetermined relationship between elongation and tensile force established for said elastic cord.

8. A method for producing a cervical spine and neck muscles strengthening apparatus, comprising:

producing a headgear comprising a first band and a second band;

producing a traction control line comprising a traction control line band, a first carabiner, a second carabiner, and a first part selected from the group consisting of a non-elastic cord and an elastic cord;

providing a special spring configured to press the traction control line band against an edge of a movable support to allow controlled sliding of the traction control line band during a height adjustment of the headgear, thereby enabling the determination of a zero traction force point where the sliding ceases;

determining an elastic force counteracting the stretching of the elastic cord based on predetermined calibration data established by testing a relationship between elongation and tensile force for said elastic cord;

and reporting values of said elongations and corresponding tensile forces for subsequent use when marking a force scale of the traction control line band starting from the zero traction force point.

9. A method for adjusting a traction force in a cervical spine and neck muscles strengthening apparatus, comprising:

providing the cervical spine and neck muscles strengthening apparatus comprising a headgear, a traction control line including a non-elastic cord and a traction control line band, a first carabiner, a second carabiner, and a special spring;

connecting a loop of the headgear with the non-elastic cord through the first carabiner;

connecting the non-elastic cord with the traction control line band through the second carabiner;

configuring the headgear to be placed on a head by fastening a first band and a second band of the headgear such that a plurality of strips intersect at lateral regions of the headgear;

locking a movable support in an open position relative to a fixed support;

positioning a seat in front of the movable support;

passing the traction control line band over the movable support above the seat;

pressing the traction control line band against an edge of the movable support using the special spring, wherein the special spring is clamped over the edge of the movable support, with a clamping portion of the spring positioned across the traction control line band to press it against the movable support;

lowering the headgear from a first vertical position corresponding to a standing height to a second vertical position corresponding to a seated height on the seat, while maintaining the traction control line in a taut state by allowing the traction control line band to slide under a friction resistance created by the special spring against the edge of the movable support;

stopping the lowering of the headgear when the second vertical position is reached, whereby the sliding of the traction control line band under the special spring ceases, thereby automatically determining a zero traction force point of the traction control line band relative to the edge of the movable support;

marking an initial mark on the traction control line band at a location corresponding to the edge of the movable support at said zero traction force point;

and removing the special spring and the traction control line band for subsequent drawing of a force scale starting from the initial mark.

10. The method of claim 9, further comprising: drawing the force scale on the traction control line band at distances from the initial mark based on values indicated in an operation manual, said values corresponding to traction forces attainable after replacing the non-elastic cord with an elastic cord and fixedly pinching the traction control line band;

wherein the marking is made starting from the initial mark in the direction of the first part of the traction control line connected to the traction control line band at that moment;

and setting a specific traction force by replacing the non-elastic cord with the elastic cord and fixedly pinching the traction control line band at a chosen mark of the scale between the movable support and the fixed support.

* * * * *